US011845587B2

(12) United States Patent
Wihlborg et al.

(10) Patent No.: US 11,845,587 B2
(45) Date of Patent: Dec. 19, 2023

(54) RESEALABLE BAG ENCLOSURE

(71) Applicant: Illinois Tool Works Inc., Glenview, IL (US)

(72) Inventors: Lars Wihlborg, Stratford, CT (US); David Matthews, Gilman, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/319,494

(22) Filed: May 13, 2021

(65) Prior Publication Data

US 2021/0354880 A1 Nov. 18, 2021

Related U.S. Application Data

(60) Provisional application No. 63/026,469, filed on May 18, 2020.

(51) Int. Cl.
*B65D 33/25* (2006.01)
*B65D 33/18* (2006.01)

(52) U.S. Cl.
CPC ..... *B65D 33/2508* (2013.01); *B65D 33/18* (2013.01)

(58) Field of Classification Search
CPC ..... B65D 33/2508; B65D 33/18
USPC ..... 383/63
See application file for complete search history.

(56) References Cited

U.S. PATENT DOCUMENTS 5,246,720 A * 9/1993 Buchko ..... B65D 75/326 426/106
5,941,643 A 8/1999 Linkiewicz
7,097,092 B1 * 8/2006 Marrale ..... B65D 5/5405 229/231
8,033,974 B2 10/2011 Yeager
9,315,299 B2 4/2016 Yeager
2007/0086683 A1 4/2007 Yeager
2007/0230834 A1 * 10/2007 Schneider ..... B65D 33/2541 383/906

(Continued)

FOREIGN PATENT DOCUMENTS

EP 0917948 A1 * 5/1999
EP 1873081 10/2008

(Continued)

OTHER PUBLICATIONS

International Preliminary Report On Patentability received for related PCT Application No. PCT/US2021/032677 dated Dec. 1, 2022 (8 pages).

*Primary Examiner* — Jes F Pascua

(74) *Attorney, Agent, or Firm* — THE SMALL PATENT LAW GROUP LLC; Josef L. Hoffmann

(57) ABSTRACT

A resealable bag enclosure may be provided that includes a film having an opposing first side and second side coupled with each other, and a resealable zipper assembly coupled with the first side and the second side of the film. The first side and the second side of the film together may form a pattern at an opening stop location disposed between the first and second edges of the film and adjacent to an end of the zipper assembly. The pattern of the first side and the second side of the film may also resist opening of the resealable bag enclosure beyond the end of the zipper assembly when the first side and the second side of the film are pulled apart to prevent the peel seal from extending beyond the pattern.

14 Claims, 2 Drawing Sheets

(56) References Cited

U.S. PATENT DOCUMENTS

| | | | | |
|---|---|---|---|---|
| 2011/0044566 | A1* | 2/2011 | Fish | B31B 70/00 383/63 |
| 2018/0170644 | A1* | 6/2018 | Beer | B65D 75/5877 |
| 2021/0107718 | A1* | 4/2021 | Singh | B65D 5/703 |
| 2021/0139217 | A1* | 5/2021 | Bogdanov | B65D 75/5866 |

FOREIGN PATENT DOCUMENTS

| | | | | |
|---|---|---|---|---|
| EP | 2668111 | | | 3/2015 |
| EP | 3000584 | | | 3/2016 |
| JP | H07246670 | A | * | 9/1995 |
| JP | 2015048080 | A | * | 3/2015 |
| PT | 1072526 | E | * | 12/2006 |
| WO | WO-0076353 | A1 | * | 12/2000 |
| WO | 2008145164 | | | 12/2008 |

* cited by examiner

RESEALABLE BAG ENCLOSURE

CROSS-REFERENCE TO RELATED APPLICATIONS

This application claims priority to U.S. Provisional Application Ser. No. 63/026,469 (filed 18 May 2020), the entire disclosure of which is incorporated by reference.

FIELD

The present disclosure relates to a resealable bag enclosure.

BACKGROUND

Resealable bags may be used for several purposes. Often resealable bags are used for containing liquids, food items, etc. As an example, a resealable bag may be used for cereal. In particular, cereal bags are typically made from a film that that is folded over and sealed to itself. To open the cereal bag, each side of the film may be grabbed and pulled apart at one end. After the cereal bag is opened and cereal dispensed, and a consumer may then roll the open end of the bag up, use a bag clip, empty all of the cereal into a sealable container, or the like. These are all methods that may be undertaken to keep the cereal fresh and to prevent the cereal from going stale.

Some bags may include a zipper assembly at an end that may be pulled apart and then resealed. By providing for resealing the end, the contents in the bag may be kept fresher without having use a clip, or use a secondary container. In some embodiments, the seal does not go the length of the film, decreasing the opening that needs to be resealed. However, often individuals opening such bags provide too much force, resulting in tearing of the bag past the zipper assembly, resulting in an opening that cannot be resealed.

BRIEF DESCRIPTION

In one or more embodiments of the subject matter described herein, a resealable bag enclosure may be provided that includes a film having an opposing first side and second side coupled with each other along opposite first and second edges and a bottom edge that extends between the first and second edges, and a resealable zipper assembly coupled with the first side and the second side of the film. The first side and the second side of the film together may form a pattern at an opening stop location disposed between the first and second edges of the film and adjacent to an end of the zipper assembly. The pattern of the first side and the second side of the film may also resist opening of the resealable bag enclosure beyond the end of the zipper assembly when the first side and the second side of the film are pulled apart. The resealable bag enclosure may also include a peel seal formed between the first side and the second side of the film above the zipper assembly, the first side and the second side of the film forming the pattern in the peel seal with the pattern in the peel seal oriented in a different direction than a pattern of the zipper assembly formed between the first side and the second side at the opening stop location to prevent the peel seal from extending beyond the pattern in the peel seal oriented in a different direction.

In one or more embodiments of the subject matter described herein, a resealable bag enclosure is provided that may include a film having an opposing first side and second side coupled with each other along opposite first and second edges and a bottom edge that extends between the first and second edges, the film having a peel seal between the sides of the film and extending from the first edge of the film to an opening stop location, and a resealable zipper assembly coupled with the first side and second side of the film, the zipper assembly extending in a first direction on the first side of the film from an end of the zipper located adjacent to the stop location to and around the first edge and back to the end of the zipper along the first direction on the second side of the film, the zipper assembly providing a resealable enclosure bounded by the sides of the film, the first and second edges of the film, and the bottom edge of the film. The first side and the second side of the film may form a pattern at the stop location, the pattern formed by elongated members in the first side and the second side of the film that are elongated in a second direction that is different from the first direction in which the zipper assembly extends.

In one or more embodiments of the subject matter described herein, a resealable bag enclosure is provided that may include a film having opposing sides coupled with each other along opposite first and second edges, and coupled with each other along a bottom edge that extends between the first and second edges, the film having a peel seal between the sides of the film and extending from the first edge of the film to an opening stop location, the film having first intermeshing members elongated in a first direction in the peel seal. The resealable bag enclosure may also include a resealable zipper assembly coupled with the opposing sides of the film, the zipper assembly extending from the first edge of the film along each of the opposing sides to an end of the zipper assembly at the opening stop location, the zipper assembly providing access into an interior of the resealable bag enclosure. The opposing sides of the film may form second intermeshing members elongated in a second direction that is different from the first direction in the opening stop location, the second intermeshing members restricting opening of the resealable bag enclosure beyond the end of the zipper assembly.

BRIEF DESCRIPTION OF THE DRAWINGS

The present inventive subject matter will be better understood from reading the following description of non-limiting embodiments, with reference to the attached drawings (which are not necessarily drawn to scale), wherein below.

DETAILED DESCRIPTION

One or more embodiments of the inventive subject matter described herein provide a resealable bag formed to have a zipper assembly that opens less than all of an end of the bag (e.g., half of the bag end) while providing protection against ripping or tearing the bag past the zipper assembly. The zipper assembly may have a peel seal that extends along an end of the bag. The peel seal may include a first portion that may be opened along the axis that the peel seal extends. The peel seal may also include a second portion that is orthogonal to the first portion at a stop location that prevents ripping or tearing of the bag after the first portion is opened. The pattern of the second portion resists additional force. To this end, on the opposite side of the stop location from the peel seal are relief areas for absorbing additional pressure resulting from force occurring when the peel seal is opened. Because the second portion of the peel seal is orthogonal to the first portion at the stop location, and because of the relief areas, undesired tearing of the bag past the peel seal opening is reduced.

Figure 1:
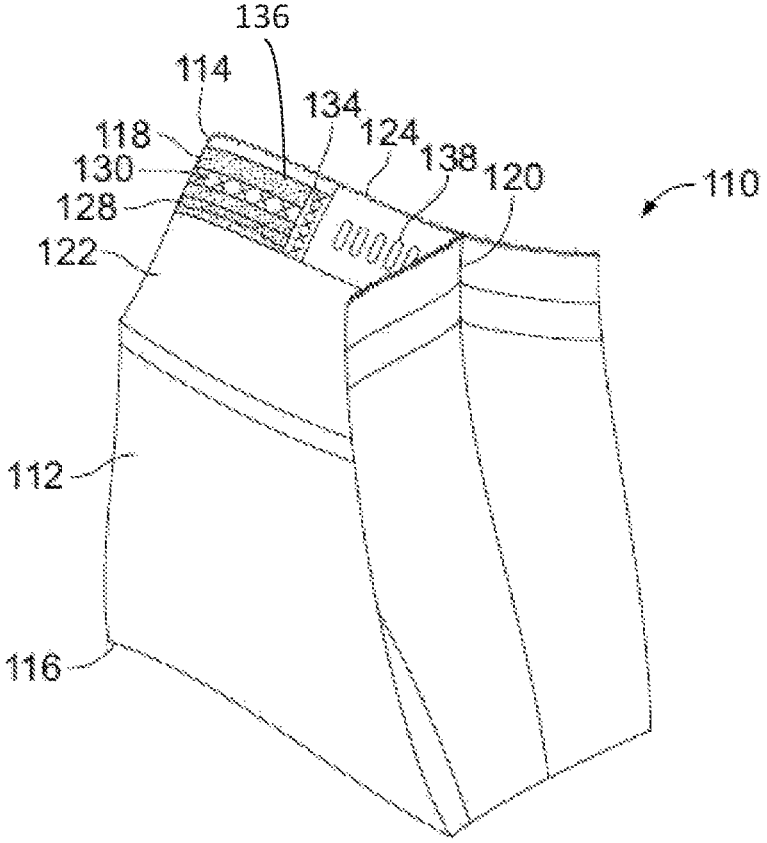
FIG. 1 illustrates a perspective view of a resealable bag in accordance with one or more embodiments of the inventive subject matter described herein.

FIG. 1 illustrates one example of a resealable bag enclosure 110. The resealable bag enclosure may be used to store liquids, solids, food items, etc. In one resealable bag enclosure 110 example, the resealable bag contains cereal. The is formed from a film 112 having a top edge 114 and opposite bottom edge 116. The film 112 also includes opposite first edge 118 and second edge 120 that each extend from the top edge 114 to the bottom edge 116. Extending from the first edge 118 and second edge 120 are opposing first and second sides 122 and 124 that do not engage one another. In this manner, the film 112 forms an enclosure above the bottom edge 116 and between the first and second edges 118 and 120. The film 112 may be formed from plastic, nylon, ceramic material, or the like.

Extending at one of the top edge 114, or bottom edge 116, is a zipper assembly 128 that may be coupled to the opposing first and second sides 122, 124. The zipper assembly 128 may include opposing teeth, groove and protrusion, matching patterns, low strength adhesive, etc. Disposed above the zipper assembly 128 may be a peel seal 130. The peel seal 130 may be joined to the film 112 and extend from the first edge 118 and terminate between the first edge 118 and second edge 120 at a stop location 134. In one example, the stop location 134 may be at a midpoint between the first edge 118 and the second edge 120. Alternatively, the stop location 134 may be located closer to the first edge 118, or to the second edge 120, yet still spaced apart from the respective edge 118 or 120.

At the stop location 134 a pattern may run orthogonal, or perpendicular, to the peel seal 130 to provide a stop element. While in one example the peel seal 130 has the same pattern as the stop element, in other examples, a second pattern is provided that may be formed to resist opening of the resealable bag enclosure beyond the end of the zipper assembly 128 when the first side and the second side of the film are pulled apart. In yet another example a gusset may be provided. A heat resistant material 136 may be on either side of the peel seal 130. Plural relief areas 138 may also be provided adjacent the peel seal 130. The relief areas 138 provide additional strain and stress relief for when excess force is applied when opening the zipper assembly 128.

Figure 2:
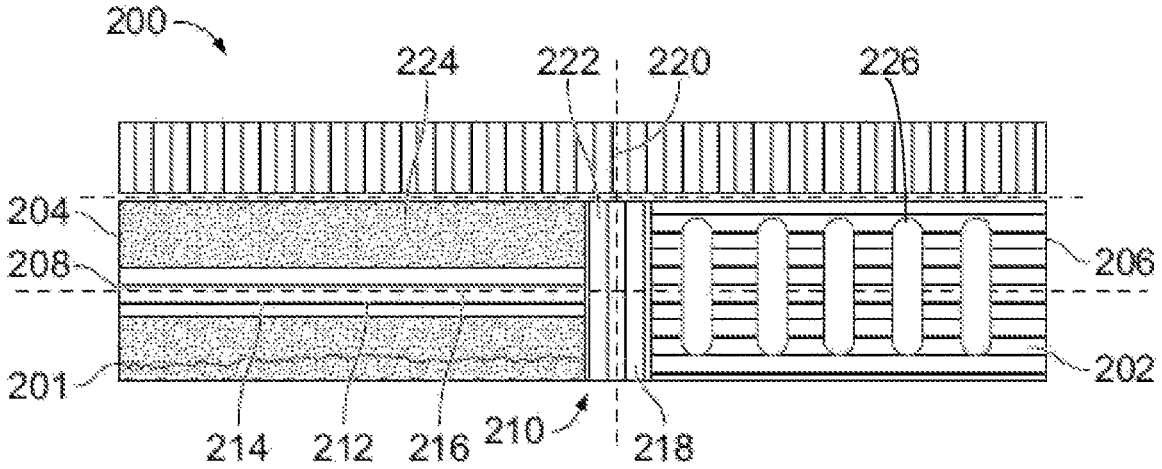
FIG. 2 illustrates a partial perspective view of a resealable bag as described herein.

FIG. 2 illustrates an example opening of a resealable bag enclosure 200. The resealable bag enclosure 200 may include a zipper assembly 201 that may be formed into a film 202. The film 202 and may extend from a first edge 204 to a second edge 206, while the zipper assembly 201 extends form the first edge 204 to point between the first and second edges 204, 206. The zipper assembly 201 may include first and second enclosure elements, opposing teeth, groove and protrusion, interlocking curves, a single closure strip that is sealed by folding back on itself to mate to itself, a single strip of closure that is sealed to the inside of the front panel of a bag enclosure and wraps around the side of the bag enclosure, is gusseted, and attaches to the inside of the back panel of the bag enclosure, etc. Within the film 202, above the zipper assembly 201, may be a peel seal 208 that may have a pattern that is on either side of a film to provide an interlocking connection.

The peel seal 208 may extend from adjacent the first edge 204 to a stop location 210. In one example, the stop location 210 may be in a middle portion between the first edge 204 and the second edge 206 and adjacent the end of the zipper assembly 201. The peel seal 208 may include a first pattern 212 that may be intermeshing polygon members 214 that extend along a first axis 216 in a first direction. At the stop location 210, a second pattern 218 may be provided that extends along a second axis 220 in a second direction that is different than the first direction. The second pattern may similarly include intermeshing polygon members 222.

In one example, the first pattern 212 and second pattern 218 extend orthogonal, or perpendicular, to one another. The first pattern 212 and second pattern 218 may including similar patterns, such as both being polygon members, or may be different patterns. In one example, the second pattern 218 at the opening stop location 210 may be formed by multiple intermeshing undulating members that are elongated in a first direction that is different from a second direction in which the zipper assembly is elongated. Alternatively, the second pattern 218 at the opening stop location 210 may be formed by elongated undulating members and intermeshing elongated polygon members, the undulating members and the polygon members elongated in a first direction that is different from a second direction in which the zipper assembly is elongated. By extending in a different direction, a barrier is provided resisting opening of the resealable bag enclosure beyond the end of the zipper assembly 201 when the first side and the second side of the film are pulled apart Surrounding the peel seal 208 may be heat resistant material 224. The heat resistant material 224 may be left unsealed to have film to grab hold of to break open the peel seal 208, and keep radiant heat from tacking the film 202 together. The heat resistant material 224 also provides a material for a cut knife to shear against. The heat resistant material 224 may also allow closure of the peel seal 208 and provide heat resistance to keep from applying heat and pressure to the peel seal 208 that may result in deforming of the peel seal 208.

Plural relief areas 226 may also be provided in the resealable bag enclosure 200. The plural relief areas 226 may be located on the opposite side of the stop location 210 of peel seal 208. In one example, the relief areas 226 may be oval, slits, square, rectangular, or the like. The relief areas 226 may be aligned, side-by-side, extend parallel to the pattern at the stop location 210, etc. Alternatively, instead of an opening, the relief area may be a thinned area in a film that has a thickness that may be less than other surrounding areas. In all, the relief areas 226 provide additional strain and stress relief for when excess force is applied when opening the peel seal 208.

Figure 3:
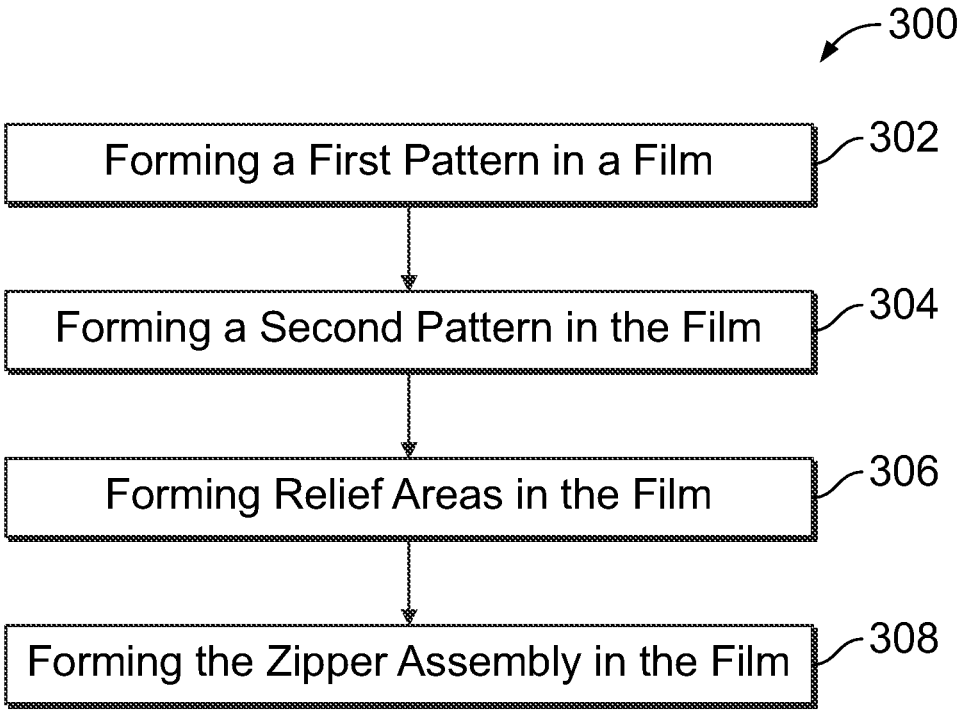
FIG. 3 a flowchart of a method of manufacturing a resealable bag in accordance with one embodiment.

FIG. 3 illustrates a method 300 of manufacturing a resealable bag enclosure. In one example, the method may be used to manufacture the resealable bag enclosure of FIG. 1.

At 302, a first pattern may be formed in a film. The film may be plastic, rubber, ceramic, or the like. The first pattern may be of any type, including intermeshing undulating members, polygons, or the like. The first pattern is provided such that the film may be opened and resealed.

At 304, a second pattern may be formed in the film. The second pattern may also be of any type, including intermeshing undulating members, polygons, etc. The second pattern may be the same as the first pattern, only extending in a direction that is different than the first pattern. The first and second patterns may be formed at the same time, at different time, in one manufacturing step, in multiple manufacturing steps, etc. In one example, the first pattern may be orthogonal to the second pattern.

At 306, relief areas are formed in the zipper assembly. The relief areas may include openings, thinned areas compared to other surrounding thicker areas, or the like. When openings are provided, the openings may be slits, ovals, rectangular, square, or the like. The relief areas may be elongated, side-by-side, parallel to one another, spaced equidistant, spaced not equidistant, or the like. In each instance, the relief areas are provided to absorb force to prevent tearing or ripping of the film as a result of opening a peel seal formed by the first pattern. The relief areas may be made at the same time as the first, and/or second pattern, at a different time, during the same manufacturing step or process, or during a different manufacturing step or process, etc.

At 308, the zipper assembly is formed, or placed into the film, below the first and second patterns. The zipper assembly may be formed at the same time as the first pattern, second pattern, and/or the relief areas, before the forming of the first pattern, second pattern, and/or relief areas, or after the first pattern, second pattern, and/or relief areas. In particular, the first and second enclosures only extend to a mid-point of the film similar to the first and second patterns, that in one example form a peel seal.

Thus, a bag enclosure and method of making the same is provided. By providing a stop location for a peel seal that has a second pattern that extends in a different direction than the first pattern, tearing or ripping from providing too much force during a cutting or opening process is reduced. Additional relief area may similarly be provided, again to absorb and reduce tearing and ripping from stress.

In one or more embodiments of the subject matter described herein, a resealable bag enclosure may be provided that includes a film having an opposing first side and second side coupled with each other along opposite first and second edges and a bottom edge that extends between the first and second edges, and a resealable zipper assembly coupled with the first side and the second side of the film. The first side and the second side of the film together may form a pattern at an opening stop location disposed between the first and second edges of the film and adjacent to an end of the zipper assembly. The pattern of the first side and the second side of the film may also resist opening of the resealable bag enclosure beyond the end of the zipper assembly when the first side and the second side of the film are pulled apart. The resealable bag enclosure may also include a peel seal formed between the first side and the second side of the film above the zipper assembly, the first side and the second side of the film forming the pattern in the peel seal with the pattern in the peel seal oriented in a different direction than a pattern of the zipper assembly formed between the first side and the second side at the opening stop location to prevent the peel seal from extending beyond the pattern in the peel seal oriented in a different direction.

Optionally, the releasable zipper assembly may extend from the end of the zipper assembly on the first side of the film to and around the first edge of the film and along the second side of the film to the end of the zipper assembly.

Optionally, the pattern at the opening stop location may be oriented perpendicular to the pattern in the peel seal.

Optionally, the peel seal may be configured to be broken to access the zipper assembly by pulling apart the first side and the second side of the film to the opening stop location without tearing or removing any part of the film.

Optionally, the pattern at the opening stop location may be formed by multiple intermeshing polygon members elongated in a first direction that is different from a second direction in which the zipper assembly is elongated.

Optionally, the pattern at the opening stop location may be formed by multiple intermeshing undulating members that are elongated in a first direction that is different from a second direction in which the zipper assembly is elongated.

Optionally, the pattern at the opening stop location may be formed by elongated undulating members and intermeshing elongated polygon members, the undulating members and the polygon members elongated in a first direction that is different from a second direction in which the zipper assembly is elongated.

Optionally, the resealable bag enclosure may also include plural relief areas in the film between the opening stop location and the second edge of the film, the relief areas including one or more of openings through the film or thinner areas of the film.

In one or more embodiments of the subject matter described herein, a resealable bag enclosure is provided that may include a film having an opposing first side and second side coupled with each other along opposite first and second edges and a bottom edge that extends between the first and second edges, the film having a peel seal between the sides of the film and extending from the first edge of the film to an opening stop location, and a resealable zipper assembly coupled with the first side and second side of the film, the zipper assembly extending in a first direction on the first side of the film from an end of the zipper located adjacent to the stop location to and around the first edge and back to the end of the zipper along the first direction on the second side of the film, the zipper assembly providing a resealable enclosure bounded by the sides of the film, the first and second edges of the film, and the bottom edge of the film. The first side and the second side of the film may form a pattern at the stop location, the pattern formed by elongated members in the first side and the second side of the film that are elongated in a second direction that is different from the first direction in which the zipper assembly extends.

Optionally, the pattern may be formed by the opposite first side and second side of the film resisting opening of the resealable enclosure beyond the end of the zipper assembly when the first side and second side of the film are pulled apart.

Optionally, the first side and second side of the film may form the pattern in the peel seal with the elongated members in the peel seal elongated in a different direction than the elongated member in the pattern at the stop location.

Optionally, the elongated members in the pattern at the stop location may be elongated in the first direction that is oriented perpendicular to the second direction in which the elongated members are elongated in the pattern in the peel seal.

Optionally, the peel seal may be configured to be broken to access the zipper assembly by pulling apart the first side and the second side of the film to the opening stop location without tearing or removing any part of the film.

Optionally, the elongated member in the pattern at the opening stop location may include multiple intermeshing polygon members.

Optionally, the elongated members in the pattern at the opening stop location may include multiple intermeshing undulating members.

Optionally, the elongated members in the pattern at the opening stop location may include undulating members and intermeshing elongated polygon members.

Optionally, the resealable bag enclosure may also include plural relief areas in the film between the opening stop location and the second edge of the film, the relief areas including one or more of openings through the film or thinner areas of the film.

In one or more embodiments of the subject matter described herein, a resealable bag enclosure is provided that may include a film having opposing sides coupled with each other along opposite first and second edges, and coupled with each other along a bottom edge that extends between the first and second edges, the film having a peel seal between the sides of the film and extending from the first edge of the film to an opening stop location, the film having first intermeshing members elongated in a first direction in the peel seal. The resealable bag enclosure may also include a resealable zipper assembly coupled with the opposing sides of the film, the zipper assembly extending from the first edge of the film along each of the opposing sides to an end of the zipper assembly at the opening stop location, the zipper assembly providing access into an interior of the resealable bag enclosure. The opposing sides of the film may form second intermeshing members elongated in a second direction that is different from the first direction in the opening stop location, the second intermeshing members restricting opening of the resealable bag enclosure beyond the end of the zipper assembly.

Optionally, the second intermeshing members may be elongated in the second direction that is oriented perpendicular to the first direction in which the first intermeshing members are elongated.

Optionally, the peel seal may be configured to be broken to access the zipper assembly by pulling apart the opposing sides of the film to the opening stop location without tearing or removing any part of the film.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure. For example, the recitation of a "mechanism for," "module for," "device for," "unit for," "component for," "element for," "member for," "apparatus for," "machine for," or "system for" is not to be interpreted as invoking 35 U.S.C. § 112(f), and any claim that recites one or more of these terms is not to be interpreted as a means-plus-function claim.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A resealable bag enclosure comprising:

a film having a first side and an opposing second side coupled with each other along opposite first and second edges and a bottom edge that extends between the first and second edges;

a resealable zipper assembly coupled with the first side and the second side of the film, wherein the first side and the second side of the film together form a zipper pattern at an opening stop location disposed between the first and second edges of the film and adjacent to an end of the resealable zipper assembly, wherein the zipper pattern of the first side and the second side of the film resists opening of the resealable bag enclosure beyond the end of the resealable zipper assembly when the first side and the second side of the film are pulled apart; and a peel seal formed between the first side and the second side of the film above the resealable zipper assembly, the first side and the second side of the film forming a peel seal pattern in the peel seal with the peel seal pattern in the peel seal oriented in a first direction that is different than a second direction of the zipper pattern of the resealable zipper assembly formed between the first side and the second side at the opening stop location to prevent the peel seal from extending beyond the peel seal pattern in the peel seal oriented in the second direction;

wherein the zipper pattern at the opening stop location is formed by one or more of 1) multiple intermeshing polygon members elongated in the first direction that is different from the second direction in which the resealable zipper assembly is elongated, 2) multiple intermeshing undulating members that are elongated in the first direction that is different from the second direction in which the resealable zipper assembly is elongated, or 3) the multiple intermeshing polygon members elongated in the first direction that is different from the second direction in which the resealable zipper assembly is elongated and the multiple intermeshing undulating members that are elongated in the first direction that is different from the second direction in which the resealable zipper assembly is elongated.

2. The resealable bag enclosure of claim 1, wherein the resealable zipper assembly extends from the end of the resealable zipper assembly on the first side of the film to and around the first edge of the film and along the second side of the film to the end of the resealable zipper assembly.

3. The resealable bag enclosure of claim 2, wherein the zipper pattern at the opening stop location is oriented perpendicular to the peel seal pattern in the peel seal.

4. The resealable bag enclosure of claim 2, wherein the peel seal is configured to be broken to access the resealable zipper assembly by pulling apart the first side and the second side of the film to the opening stop location without tearing or removing any part of the film.

5. The resealable bag enclosure of claim 1, further comprising:

plural relief areas in the film between the opening stop location and the second edge of the film, the relief areas including one or more of openings through the film or thinner areas of the film.

6. A resealable bag enclosure comprising:

a film having a first side and an opposing second side coupled with each other along opposite first and second edges and a bottom edge that extends between the first and second edges, the film having a peel seal between the first and second sides of the film and extending from the first edge of the film to an opening stop location; and a resealable zipper assembly coupled with the first side and second side of the film, the resealable zipper assembly extending in a first direction on the first side of the film from an end of the resealable zipper assembly located adjacent to the opening stop location to and around the first edge and back to the end of the resealable zipper assembly along the first direction on the second side of the film, the resealable zipper assembly providing a resealable enclosure bounded by the first and second sides of the film, the first and second edges of the film, and the bottom edge of the film, wherein the first side and the second side of the film form a pattern at the opening stop location, the pattern formed by elongated members in the first side and the second side of the film that are elongated in a second direction that is different from the first direction in which the resealable zipper assembly extends;

wherein the elongated members in the pattern at the opening stop location includes at least one of 1) multiple intermeshing polygon members, 2) multiple intermeshing undulating members, or 3) the multiple intermeshing polygon members and the multiple intermeshing undulating members.

7. The resealable bag enclosure of claim 6, wherein the pattern formed by the opposite first side and second side of the film resisting opening of the resealable enclosure beyond the end of the resealable zipper assembly when the first side and the second side of the film are pulled apart.

8. The resealable bag enclosure of claim 6, wherein the first side and second side of the film form a first pattern in the peel seal; wherein the pattern at the opening stop location is a second pattern at the opening stop location; and the first pattern in the peel seal having the elongated members in the peel seal elongated in a different direction than the elongated members in the second pattern at the opening stop location.

9. The resealable bag enclosure of claim 8, wherein the elongated members in the second pattern at the opening stop location are elongated in the first direction that is oriented perpendicular to the second direction in which the elongated members are elongated in the first pattern in the peel seal.

10. The resealable bag enclosure of claim 6, wherein the peel seal is configured to be broken to access the resealable zipper assembly by pulling apart the first side and the second side of the film to the opening stop location without tearing or removing any part of the film.

11. The resealable bag enclosure of claim 6, further comprising:

plural relief areas in the film between the opening stop location and the second edge of the film, the relief areas including one or more of openings through the film or thinner areas of the film.

12. A resealable bag enclosure comprising:

a film having opposing sides coupled with each other along opposite first and second edges, and coupled with each other along a bottom edge that extends between the first and second edges, the film having a peel seal between the sides of the film and extending from the first edge of the film to an opening stop location, the film having first intermeshing members elongated in a first direction in the peel seal; and a resealable zipper assembly coupled with the opposing sides of the film, the resealable zipper assembly extending from the first edge of the film along each of the resealable opposing sides to an end of the resealable zipper assembly at the opening stop location, the resealable zipper assembly providing access into an interior of the resealable bag enclosure;

wherein the opposing sides of the film form second intermeshing members elongated in a second direction that is different from the first direction in the opening stop location, the second intermeshing members restricting opening of the resealable bag enclosure beyond the end of the resealable zipper assembly.

13. The resealable bag enclosure of claim 12, wherein the second intermeshing members are elongated in the second direction that is oriented perpendicular to the first direction in which the first intermeshing members are elongated.

14. The resealable bag enclosure of claim 12, wherein the peel seal is configured to be broken to access the resealable zipper assembly by pulling apart the opposing sides of the film to the opening stop location without tearing or removing any part of the film.

* * * * *